United States Patent [19]

Judkins

[11] Patent Number: 4,557,309

[45] Date of Patent: Dec. 10, 1985

[54] SUN BLIND

[75] Inventor: Ren S. Judkins, Salt Lake City, Utah

[73] Assignee: Verosol USA Inc., Pittsburgh, Pa.

[21] Appl. No.: 525,871

[22] Filed: Aug. 24, 1983

[51] Int. Cl.[4] ..... E06B 9/262; A47H 3/10

[52] U.S. Cl. ..... 160/84 R; 160/279

[58] Field of Search ..... 160/84 R, 166 R, 167, 160/168 R, 168 A, 169, 170, 259, 279

[56] References Cited

U.S. PATENT DOCUMENTS

| | | | |
|---|---|---|---|
| 1,289,281 | 12/1918 | Shaft | 160/84 R |
| 1,728,074 | 9/1929 | Nicholas | 160/84 R |
| 4,202,395 | 5/1980 | Heck et al. | 160/84 R |
| 4,212,341 | 7/1980 | Fisher | 160/84 R |
| 4,326,577 | 4/1982 | Tse | 160/279 |
| 4,443,915 | 4/1984 | Niemeyer | 160/84 R |

*Primary Examiner*—Ramon S. Britts
*Assistant Examiner*—Cherney S. Lieberman
*Attorney, Agent, or Firm*—Kenyon & Kenyon

[57] ABSTRACT

A sun blind suitable for installation in, for example, window openings, including window openings having an inclination from the vertical, is disclosed. The sun blind comprises a first bar disposed at the top of the window opening, a second bar movable with respect to the first bar, a foldable sun blinding member attached between the first and second bars and a third bar disposed at the bottom of the window opening. A first cord arrangement is used to move the second bar and thus the sun blinding member. A second cord arrangement is used to guide the second bar and the sun blinding member. A suitable tension means, such as a spring, preferably located in the third bar, applies tension to the second cord arrangement so as to keep the cords of the second cord arrangement taut and thus properly guide the sun blinding member and the second bar with respect to the inclination of the window opening.

5 Claims, 8 Drawing Figures

SUN BLIND

BACKGROUND OF THE INVENTION

The present invention relates to the field of sun blinds and in particular, to an improved sun blind which can be used not only in conventional vertically disposed window and door openings, for example, but also in openings which are inclined from the vertical, such as in the case of skylights or sun roofs, which might be located in the roofs or ceilings of building structures.

The need exists for sun blinds which can be used in applications in which the window opening and thus the blind, may be disposed not only vertically, but also at an angle from the vertical. Such a sun blind is disclosed in copending patent application, Ser. No. 449,780, filed Dec. 14, 1982, now U.S. Pat. No. 4,473,101, as assigned to the assignee of this application. In this design, guiding rails or bars disposed, for example, along the sides of the window opening, are utilized to guide the moving bar to which the sun blinding portion, which may be pleated, or of some other foldable design, is attached. This arrangement is preferable in applications wherein it is desired that the cords utilized in raising, lowering and guiding the sun blind be hidden from view. This design also allows the moving bar to which the sun blinding portion is attached to be grasped by a user to open or close the blind, instead of pulling on a pull cord.

The present invention provides for an improved sun blind of the type wherein the cord arrangement is exposed to view and wherein a pull cord is used to raise the blind and to initiate lowering the blind under its own weight due to gravity. Due to the novel structure of the present invention, the sun blind may be used in applications wherein the window opening is disposed not only vertically, but at other angles from the vertical.

SUMMARY OF THE INVENTION

Accordingly, it is an object of the present invention to provide a sun blind which can be installed not only vertically, but at an angle from the vertical.

It is a further object of the present invention to provide a sun blind which uses separate cord arrangements for guiding the sun blind and for raising and lowering the sun blind.

It is a yet further object of the invention to provide a sun blind which can be adapted for use in openings of varying size.

These and other objects of the present invention are achieved by a sun blind comprising: a first horizontal bar; a second horizontal bar adapted for movement with respect to the first bar; a foldable sun blinding member attached to the first and second bars; a third bar disposed below the second bar; first cord means for moving the second bar and the sun blinding member with respect to the first bar, the cord means coupled to and extending at least partly through the second bar in a direction substantially parallel to the longitudinal direction of the second bar, the sun blinding member having a plurality of aligned openings disposed therein, the cord means further being disposed in the plurality of openings, the cord means extending at least partly through the first bar in a direction substantially parallel to the longitudinal direction of the first bar and exiting at one end of the first bar and terminating in a pull cord operable to move the second bar; second cord means for guiding the sun blinding member and the second bar during movement of the sun blinding member and second bar, the second cord means being coupled to and extending at least partly through the first bar in a direction substantially parallel to the longitudinal direction of the first bar, through the plurality of aligned openings in the sun blinding member, through the second bar in a direction substantially perpendicular to the longitudinal direction of the second bar, and at least partly through the third bar in a direction substantially parallel to the longitudinal direction of the third bar, the second cord means being coupled to the third bar; and means for providing tension on the second cord means during movement of the second bar and the sun blinding member.

These and other novel features and advantages of the invention will be explained in greater detail in the detailed description below.

BRIEF DESCRIPTION OF THE DRAWINGS

The present invention will be described in greater detail in the following detailed description with reference to the drawings, in which.

DETAILED DESCRIPTION

Figure 1:
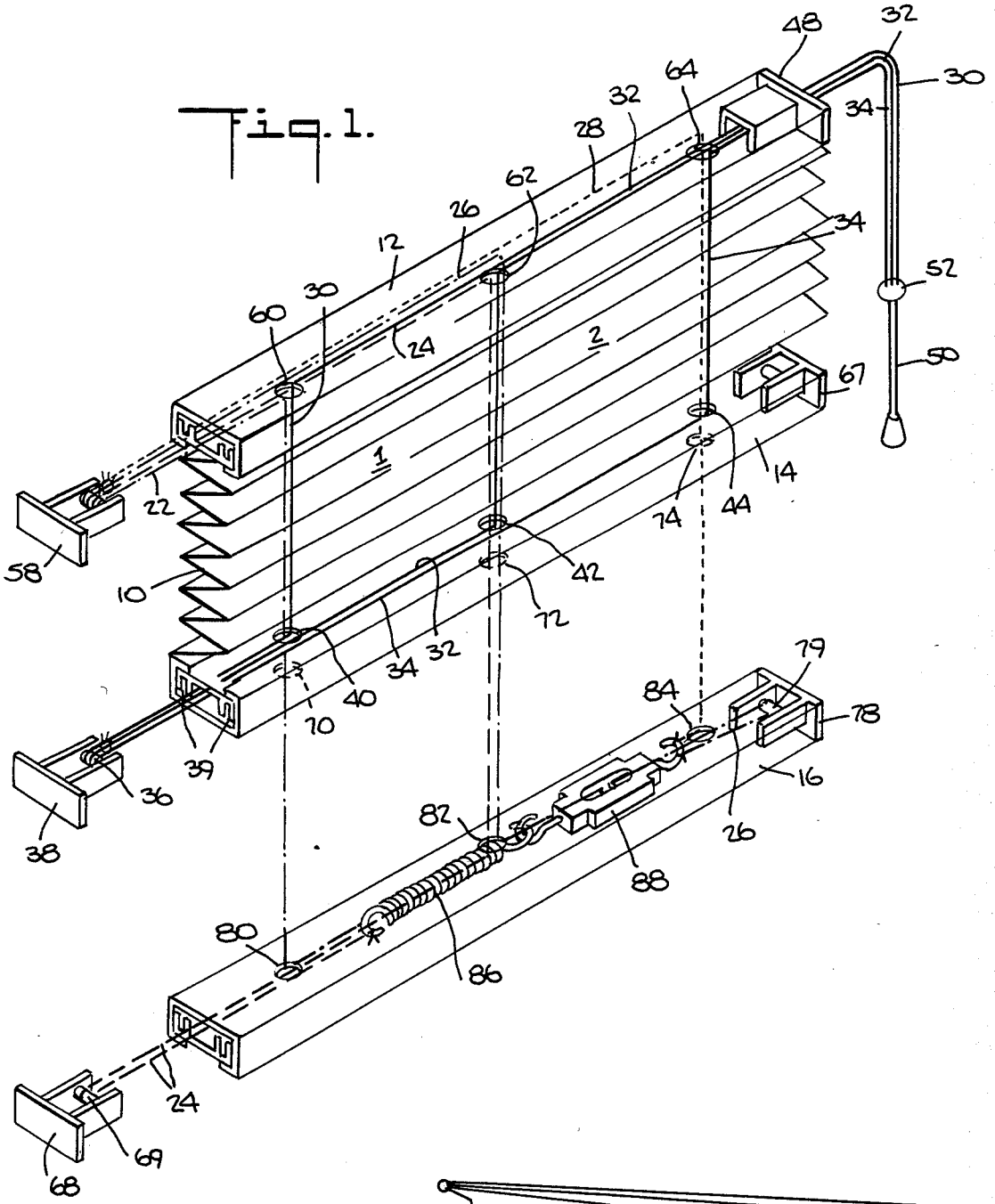
FIG. 1 is a partly exploded perspective view showing a preferred embodiment of the sun blind and illustrating the cord arrangement in phantom view.

With reference now to the drawings, a "two panel" sun blind is shown in FIG. 1, the panels designated by the numerals 1 and 2. This sun blind is called "two panel" because the guide cords 22, 24, 26 and 28, to be described below, create a "two panel" design when the sun blind is disposed in a window opening, although the sun blind, and particularly the sun blinding member 10, may be a one-piece unit extending the entire width of the window opening. Although the sun blind is described herein as disposed in a window opening, it is to be understood that the invention can also be used in other openings, such as in front of glass doors or skylights, for example.

The sun blind comprises a foldable sun blinding member 10, which may be pleated as shown, attached between a top bar or headrail 12 and a moving bar or traversing rail 14. A bottom bar or rail 16 is disposed along the bottom of the opening, such as on a window sill.

Figure 3:
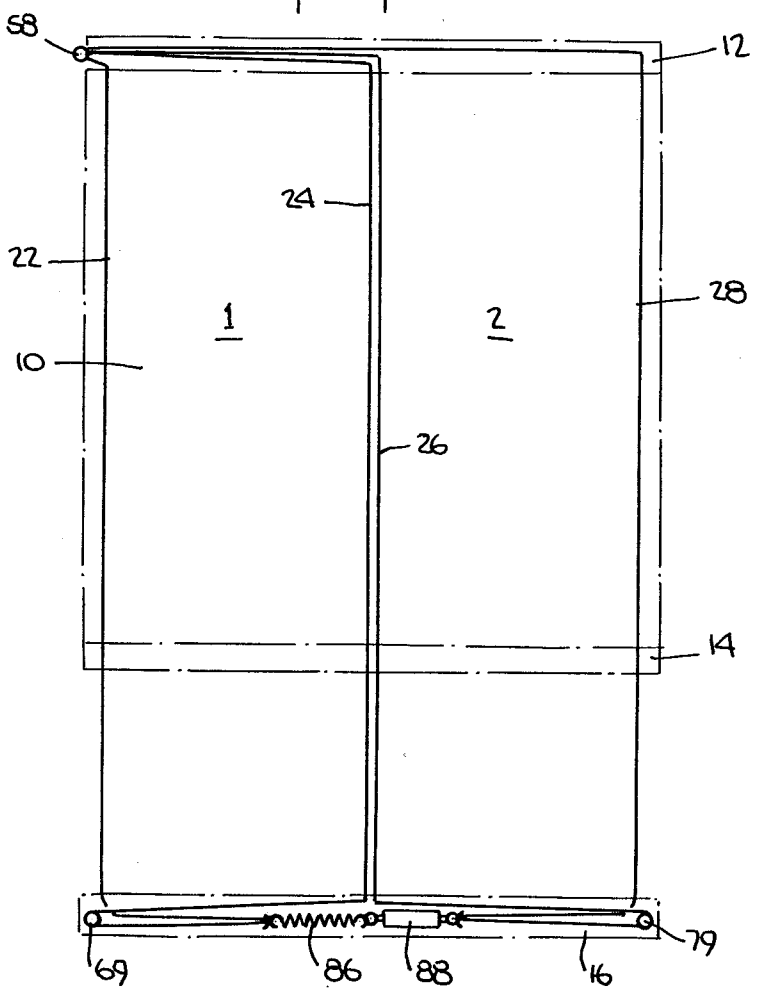
FIG. 3 is a simplified view of the cord arrangement used for guiding the sun blind shown in FIG. 1.
Figure 2:
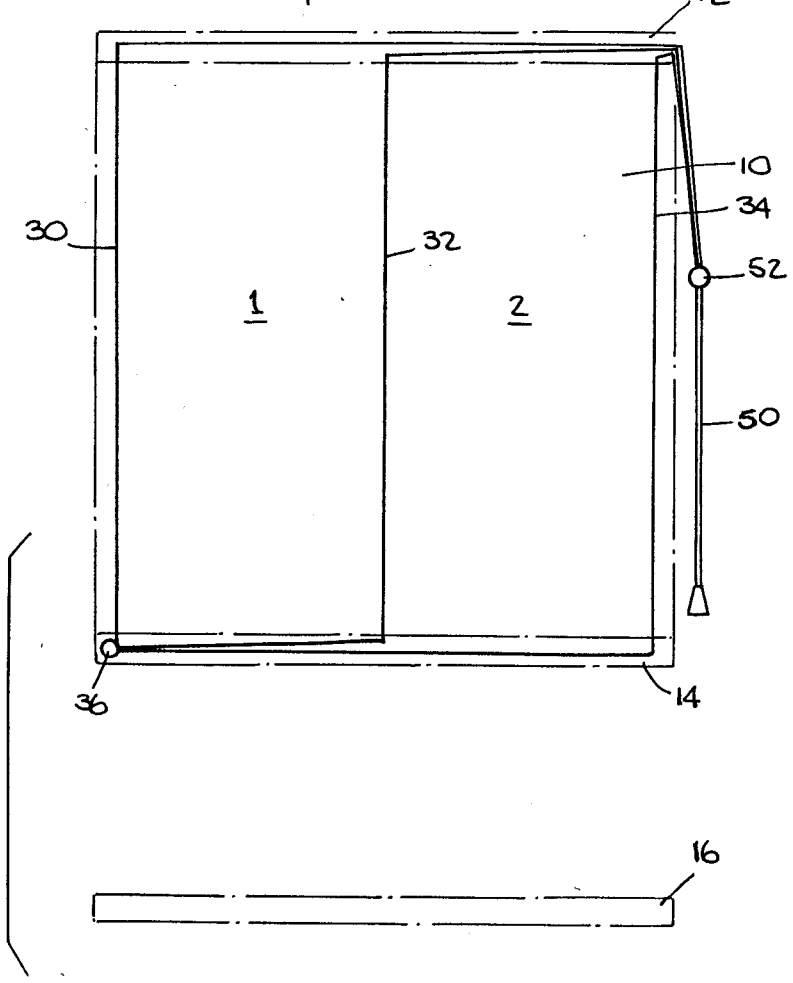
FIG. 2 is a simplified view illustrating the cord arrangement used in raising and lowering the sun blind shown in FIG. 1.

A cord arrangement is used to raise and lower and guide the sun blinding member 10. As shown in FIG. 1, and more clearly in FIGS. 2 and 3, the cord arrangement includes two separate cord structures, one for raising and lowering the sun blinding member 10 and the other for guiding the sun blinding member. FIG. 2 shows the cord structure used to raise and lower the sun blinding member 10 and FIG. 3 shows the cord structure used for guiding the sun blinding member. Both cord structures are visible in FIG. 1.

The cord structure used to raise and lower the two panel sun blind of FIG. 1 includes cords 30, 32 and 34 which are tied together at point 36, which might be a peg, as shown, of an end cap 38 which mates with approximately shaped channels 39 in hollow traversing rail 14. A similar end cap 67 may be provided at the other end of traversing rail 14 and at the ends of headrail 12 and bottom rail 16. Cords 30, 32 and 34 are disposed in hollow traversing rail 14 substantially parallel to its longitudinal direction and exit through respective openings 40, 42 and 44 in the upper surface of rail 14. From these openings, the cords travel upwards through respective pluralities of aligned openings in the pleats of sun blinding member 10 and thence through hollow headrail 12 to the end designated 48, which end may be another end cap having an opening therein so that cords 30, 32 and 34 may exit, ultimately terminating in pull cord 50. Cords 30, 32 and 34 may be tied together in a cord ball or knot 52. Cords 30, 32 and 34 may be appropriately tied off by a peg or eyelet (not shown) disposed alongside the window opening or at a distance therefrom in order to secure the blind in a fixed position. Alternatively, end cap 48 may include a cord locking device for locking the cords in a fixed position so that the traversing rail 14 locks in the desired position after pull cord 50 is adjusted by the user. The three cord structure shown in FIG. 2 provides equal tension on traversing rail 14 so that, for example, when the sun blind is disposed vertically in a window opening, traversing rail 14 is raised evenly and does not assume an oblique position in the window opening. Although three cords are shown, a lesser number could be used. For example, for smaller sun blinds, two cords could be used and the middle cord 32 could be dispensed with. When it is desired to lower the blind, cords 30, 32 and 34 are untied from the peg or eyelet securing them or the cords are appropriately manipulated to unlock the cord locking device and the blind is lowered under its own weight by the user to its desired position.

A second cord structure for guiding the sun blinding member 10 is shown in FIG. 3 as well as in FIG. 1. This cord structure preferably includes four cords as shown, although a lesser number could be used. For a "two panel" sun blind, however, four cords provide sufficient guiding action and equal tension on all the cords, so this is preferable. The guide or tension cords include cords 22, 24, 26 and 28 as shown. All four cords originate in end cap 58 of headrail 12. Cord 22 runs partly through hollow headrail 12 to a hole 60 and thence through the respective plurality of aligned openings in the sun blinding member 10, through the hole defined by openings 40 and 70 in traversing rail 14 and to the bottom rail 16, entering the bottom rail through hole 80 and being tied to one end of spring 86. The other end of spring 86 is preferably connected to a screw adjusting means, such as a turnbuckle 88 so that the tension on the tension cords may be adjusted. The other end of the turnbuckle 88 is tied to other cords of the second cord structure, to be explained below.

Cords 24, 26 and 28 similarly originate at end cap 58 and travel through headrail 12 to respective holes in the headrail. Cords 24 and 26 both exit through hole 62 and run through a plurality of aligned openings in the sun blinding member 10 to the traversing rail, where the two cords enter via hole 42 and exit via hole 72. From there, the two cords run to the bottom rail, entering the bottom rail at hole 82 and travelling to respective opposite ends 68 and 78 of the bottom rail, where they loop around respective pegs 69 and 79 provided in the respective end caps 68 and 78 and are tied, respectively, to one end of spring 86 and to one end of turnbuckle 88.

Cord 28 exits from headrail 12 through hole 64 and then runs through the series of aligned openings in the sun blinding member 10 to the traversing rail 14, where it enters and exits through holes 44 and 74 and then runs to the bottom rail 16, where it enters through hole 84 and is then tied to turnbuckle 88.

The cord structure just described and specifically depicted in FIG. 3 guides the sun blinding member 10 when the member 10 is raised and lowered by the cord structure specifically shown in FIG. 2. In particular, when the sun blind is installed in a non-vertical position, the cords shown in FIG. 3 maintain the sun blind in alignment with the slope of the window opening. The tension on the cords is adjusted by means of the turnbuckle 88 and spring 86, although the turnbuckle is not necessary but helps in obtaining the proper tension on the cords.

An advantage of the sun blind described is that it may be used at angles from the vertical. Specifically, the sun blind may be disposed at any angle between the vertical and approximately 60° from the vertical, i.e., 30° from the horizontal. At angles more nearly horizontal, insufficient gravitational components in the direction along the guiding cords are present to enable the sun blind to be lowered under its own weight.

Although the cord structures described with reference to FIGS. 2 and 3 show 3 and 4 separate cords, respectively, it is obvious that a lesser number of cords could be used in each case or that a single cord could be used in each case, appropriately tied off, looped and directed.

Figure 4:
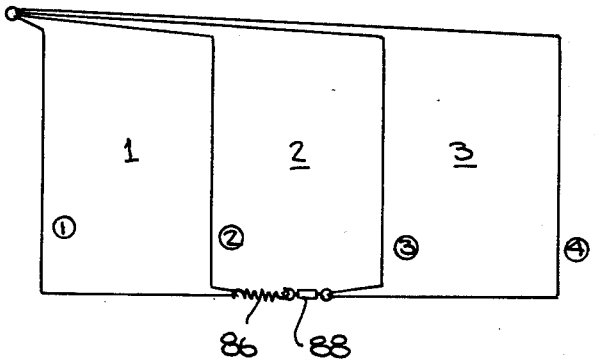
FIGS. 4 through 8 illustrate cord arrangements which may be used for guiding sun blinds of larger sizes than that shown in FIG. 1.
Figure 5:
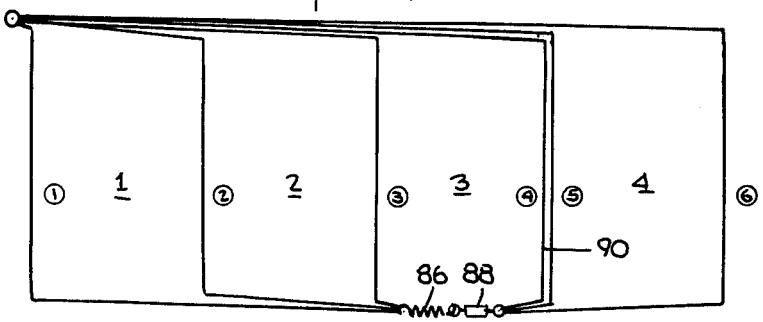
Figure 6:
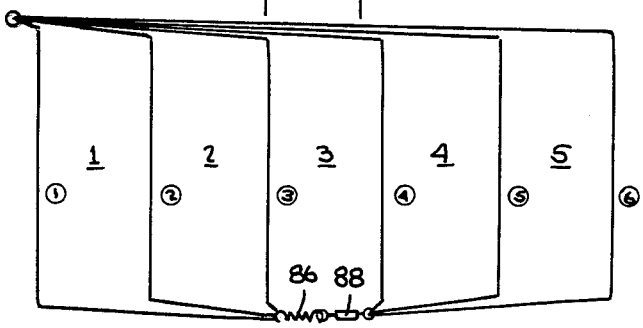
Figure 7:
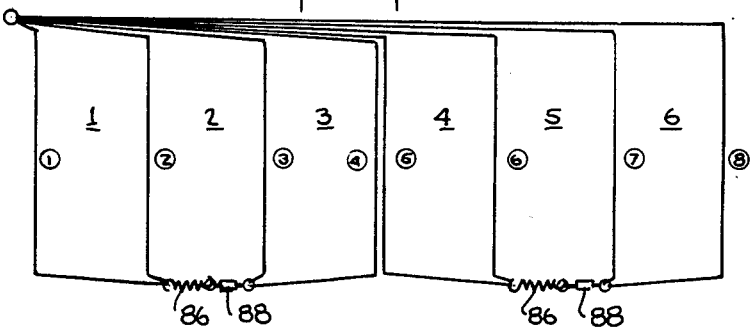
Figure 8:
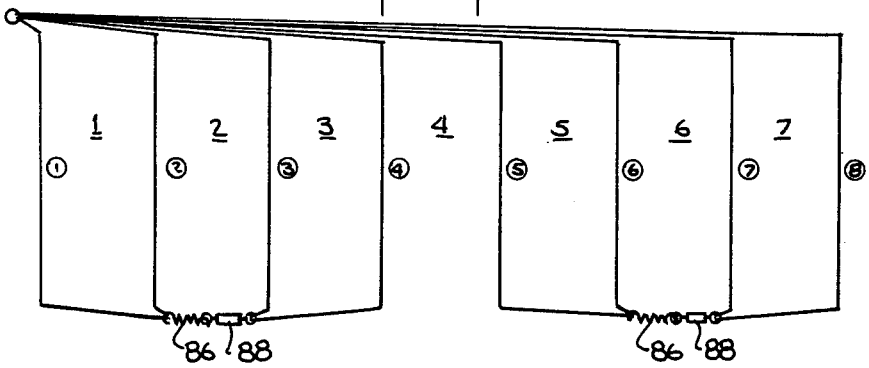

FIGS. 4 through 8 show tension or guide cord arrangements for larger sun blinds. The large underlined numbers indicate the respective "panels" while the circled numbers indicate the cords. The cord arrangements for raising and lowering the sun blind are substantially the same as that shown in FIGS. 1 and 2, although an appropriately larger number of cords may be used. FIG. 4 shows the tension cord arrangement for a "three panel" sun blind. FIG. 5 shows the tension cord arrangement for a "four panel" blind. Six tension cords are used so that equal tensions are provided on all the cords by spring 86. Thus, two tension cords appear in one series of openings in the sun blinding member as shown at 90. Similarly, FIGS. 6, 7 and 8 show the tension cord arrangements for five, six and seven panel sun blinds. For larger window openings, appropriate modifications may be made to the tension cord arrangements so as to provide appropriate means for guiding the sun blind.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A sun blind comprising:

a first horizontal bar;

a second horizontal bar adapted for movement with respect to the first bar;

a foldable sun blinding member attached to said first and second bars;

a third bar disposed below the second bar;

first cord means for moving said second bar and said sun blinding member with respect to said first bar, said cord means coupled to and extending at least partly through said second bar in a direction substantially parallel to the longitudinal direction of said second bar, said sun blinding member having a plurality of aligned openings disposed therein, said cord means extending through apertures in said second bar aligned with said aligned openings in said sun blinding member and further being disposed in said plurality of openings, said cord means extending through apertures in said first bar aligned with said aligned openings in said sun blinding member and further extending at least partly through said first bar in a direction substantially parallel to the longitudinal direction of said first bar and exiting at a first end of said first bar and terminating in a pull cord operable to move said second bar, said first cord means comprising first and second cords and said plurality of aligned openings comprising first and second series of aligned openings disposed adjacent the ends of said sun blinding member, said first and second cords being disposed in respective ones of said first and second series of openings and coupled to one end of said second bar;

second cord means for guiding said sun blinding member and said second bar during movement of said sun blinding member and second bar, said second cord means being coupled to a second end of said first bar opposite said first end and extending at least partly through said first bar in a direction substantially parallel to the longitudinal direction of said first bar, through said apertures in said first bar and said plurality of aligned openings in said sun blinding member, through said apertures in said second bar in a direction substantially perpendicular to the longitudinal direction of said second bar, and through apertures in said third bar and at least partly through said third bar in a direction substantially parallel to the longitudinal direction of said third bar, said second cord means being coupled to said third bar, said second cord means comprising third and fourth cords disposed respectively in said first and second series of aligned openings, said tension means being disposed in said third bar, said third and fourth cords being coupled together by said tension means, said tension means maintaining said third and fourth cords in a taut condition, said second cord means further comprising fifth and sixth cords and said sun blinding member further including at least one third series of aligned openings disposed between said first and second series of aligned openings, said fifth and sixth cords being disposed in at least one of said third series of aligned openings, said fifth and sixth cords further extending through said third bar and being coupled together by said tension means; and means for providing tension on said second cord means during movement of said second bar and said sun blinding member, said second cord means comprising an even number of at least four cords, thereby allowing said tension means to provide equal tension on said cords of said second cord means and allowing said second cord means to provide sufficient guidance for said sun blinding member.

2. The sun blind recited in claim 1, further comprising a seventh cord disposed in at least one of said third series of aligned openings and coupled to said one end of said second bar.

3. The sun blind recited in claim 1, further comprising pin means disposed at the ends of said third bar, said fifth and sixth cords extending in opposite directions in said third bar to respective ones of said pin means, said fifth and sixth cords looping around said respective pin means and being coupled together by said tension means.

4. The sun blind recited in claim 3, wherein said tension means comprises spring means.

5. The sun blind recited in claim 4 wherein said tension means further comprises screw adjusting means coupled to said spring means for adjusting the tension applied to the cords of said second cord means by said tension means.

* * * * *

UNITED STATES PATENT AND TRADEMARK OFFICE

CERTIFICATE OF CORRECTION

PATENT NO. : 4,557,309

DATED : December 10, 1985

INVENTOR(S) : Ren S. Judkins

It is certified that error appears in the above-identified patent and that said Letters Patent is hereby corrected as shown below:

Col. 2, line 68-Col. 3, line 1, change "approximately" to --appropriately--.

Signed and Sealed this

*Sixth* Day of *May 1986*

[SEAL]

*Attest:*

DONALD J. QUIGG

*Attesting Officer*

*Commissioner of Patents and Trademarks*